US007250843B2

(12) United States Patent
Richter et al.

(10) Patent No.: US 7,250,843 B2
(45) Date of Patent: Jul. 31, 2007

(54) TUBULAR FUSE COMPONENT WITH END CAPS WITH A HERMETICALLY SEALING PLASTIC SEALING BODY INSERT

(75) Inventors: Ludger Richter, Lüdinghausen (DE); Andreas Baus, Dortmund (DE); André Jöllenbeck, Witten (DE)

(73) Assignee: Wickmann-Werke GmbH, Witten (DE)

( * ) Notice: Subject to any disclaimer, the term of this patent is extended or adjusted under 35 U.S.C. 154(b) by 0 days.

(21) Appl. No.: 10/925,196

(22) Filed: Aug. 24, 2004

(65) Prior Publication Data

US 2005/0057337 A1 Mar. 17, 2005

(30) Foreign Application Priority Data

Aug. 25, 2003 (DE) ..... 103 39 441

(51) Int. Cl.
*H01H 85/43* (2006.01)
*H01H 85/165* (2006.01)
*H01H 85/38* (2006.01)

(52) U.S. Cl. ..... 337/250; 337/228; 337/248

(58) Field of Classification Search ..... 337/187, 337/142, 186, 228, 248, 250
See application file for complete search history.

(56) References Cited

U.S. PATENT DOCUMENTS 2,953,665 A * 9/1960 Cox ..... 337/248
3,144,534 A * 8/1964 Baumbach ..... 337/164
(Continued)

FOREIGN PATENT DOCUMENTS

DE 101 23 038 A 1 11/2002

OTHER PUBLICATIONS

"Silicone Rubber Sponge / Foam Profiles" Ipotec Inc. Jan. 24, 2001. Http://web.archive.org/web/20010124034000/http://www.ipotec.com/Spprdata.htm.*

*Primary Examiner*—Anatoly Vortman
(74) *Attorney, Agent, or Firm*—Bell Boyd & Lloyd, LLP

(57) ABSTRACT

A fuse component (1) has a fusible conductor (2) which extends in a gas filled cavity (3) within a cylindrical tube (4) between two end surfaces (8). Two end caps (5) of an electrically conductive material are applied to the ends of the tube (4) so that an electrical contact is produced with the fusible conductor (2). At at least one of the two ends of the tube (4), a sealing body of a plastic material, which is predominantly elastically compressible but at the same time capable of creep, is introduced into a gap between the base of the end cap and the end surface (8) of the tube (4) and into a portion of the cavity adjacent to the cap base. The sealing body has been compressed between the end surface (8) and the cap base during the manufacture of the fuse component (1) when positioning the end cap (5). The compressed sealing body (7) attempts to expand again, whereby it expands principally into the cavity (3). If a sudden pressure rise occurs in the cavity shortly after its introduction during the manufacturing process as a result of a temperature increase, it can occur that this overpressure balances out into the external surroundings via a temporarily formed passage between the tube, the sealing body and the end cap. The passage which is formed is then sealed again as a result of the ability of the plastic material to creep.

19 Claims, 1 Drawing Sheet

U.S. PATENT DOCUMENTS 3,179,773 A * 4/1965 Keeley, Sr. ..... 337/276
3,685,682 A * 8/1972 Frey, III ..... 220/359.1
3,723,930 A * 3/1973 Koch ..... 337/158
3,946,351 A * 3/1976 Bronikowski et al. ..... 337/224
3,962,668 A * 6/1976 Knapp, Jr. ..... 337/228
4,158,187 A * 6/1979 Perreault ..... 337/248
4,656,453 A * 4/1987 Reeder ..... 337/236
5,103,203 A * 4/1992 Huber ..... 337/248
5,235,307 A * 8/1993 Oh ..... 337/228
2002/0190837 A1* 12/2002 Kalra et al. ..... 337/187
2004/0021546 A1* 2/2004 Nakano et al. ..... 337/186

* cited by examiner

TUBULAR FUSE COMPONENT WITH END CAPS WITH A HERMETICALLY SEALING PLASTIC SEALING BODY INSERT

BACKGROUND OF THE INVENTION

The invention relates to a fuse component with a fusible conductor, which extends within a gas filled cavity in a cylindrical tube between two end surfaces of the tube, two end caps of an electrically conductive material being applied to the two ends of the tube such that a respective electrical contact with the fusible conductor is produced. The invention further relates to a method of manufacturing such a fuse component.

Tubular fuse components of the type referred to above have been known for a long time. There are, for instance, fuse components, in which the cylindrical tube consists of a ceramic material and has a circular cylindrical internal cavity and a rectangular outer contour with rounded edges. The fusible conductor is, for instance, a wire, which extends diagonally within the cavity such that it contacts the walls of the tube merely at its ends. The wire of the fusible conductor is passed around the end surfaces of the tube, whereby the ends of the fusible conductor wire engage the external walls of the tube. Metallic end caps are placed on the two ends of the tube. The end caps can, for instance, be of an elastic material and pressed on to the ends of the tube, whereby the pressing on process ensures not only a firm fit of the end cap but also electrical contact with the fusible conductor. The metal caps can also be secured to the ends of the tube by adhesive or, after appropriate preparation of the surface of the outer wall of the tube, soldered to it. A number of techniques are known for applying the end caps which ensure not only a firm fit of the caps but also good electrical contact with the fusible conductor.

There are fuse components of the type referred to above, in which a gap remains between the end caps and the wall of the tube such that the interior of the tube is connected to the surroundings of the tube via the gap. In this event, there is a gas exchange between the cavity and the surroundings. In the event of heating and expansion of the gas in the cavity, it flows out of the cavity so that a relatively rapid pressure balance occurs.

There are additionally fuse components, in which the caps are so applied to the end of the tube that the cavity is hermetically sealed. With these components, the cavity can be filled with air or with a special gas (for instance nitrogen) under normal pressure or reduced pressure.

If the fusible conductor in the interior of the tube is ruptured (blows; i.e., the fuse cuts out), an arc generally forms. The impulsive energy supply as a result of the arc heats the gas optionally present in the cavity and the materials which vaporize when blowing occurs. With a fuse component with a hermetically sealed cavity and an air or gas filling, the energy supplied by the arc results in a sudden, step increase in the pressure in the cavity of the fuse component. This pressure pulse has a quenching action on the arc and is thus desirable.

Of disadvantage, however, with a fuse component with a hermetically sealed cavity is the fact that the pressure increase in the cavity is also produced if the fuse component is heated from the exterior, for instance in the manufacturing process. Such heating occurs, for instance, when the end caps are briefly brought to a relatively high temperature to produce a solder connection between the ends of the fusible conductor and the positioned, metallic end caps. A temperature increase can also occur during a curing process of an adhesive, which is to connect the end caps to the tube. The pressure increase, associated with such heating, in the interior of the tube results in an undesired loading of the fuse component and possibly in the formation of a pressure balancing passage (capillary passage) between the cavity in the tube and the surroundings through the gap between the tube and the end cap. The formation of such an undesired capillary adjacent to the fusible conductor was determined, for instance, in fuse components which are sealed in their end regions with a pourable silicone.

It is therefore the object of the invention to provide a fuse component of the type referred to above, whose interior is hermetically sealed, in operation, but in which the problems of the type referred to above occurring in the event of sudden temperature and pressure increases during manufacture of the component are avoided.

This object is solved by a fuse component with the features of claim 1. The object is also solved by a method of manufacturing a fuse component with the features of claim 10.

SUMMARY OF THE INVENTION

The fuse component in accordance with the invention is a component of the type referred to above, which is characterized in that inserted at at least one of the two ends of the tube in a gap between the cap base of the end cap and the end surface of the tube and in a portion of the cavity of the tube adjoining the cap base there is a sealing body of plastic material, which is predominantly elastically compressible but is at the same time capable of creep (in the sense of being flowable), whereby the sealing body has been compressed between the end surface and the cap base when positioning the end cap during the manufacture of the fuse component. The sealing body, which is compressed during insertion, then attempts to expand again, whereby it expands primarily in to the interior of the tube. If a sudden pressure increase occurs in the cavity shortly after its insertion during the manufacturing process as a result of a manufacturing step which results in a temperature increase in the cavity, it can occur that this overpressure reaches equilibrium into the external surroundings via a temporarily formed passage between the tube, the sealing body and the end cap. As a result of the fact that the plastic material is capable of creep, the passages thus formed and also any remaining gaps between the tube, the end cap and the fusible conductor inserted between them is closed by the flowing in of the plastic material. After a predetermined time of equilibrium or storage, a hermetic seal of the cavity of the tube thus forms. The fuse component in accordance with the invention also permits relatively simple manufacture because, instead of some liquid sealing material, a substantially solid sealing body is used, the shape of which can be previously matched to the dimensions of the end cap.

The plastic material, which is elastically compressible but at the same time capable of creep, is preferably a silicone. This plastic material can well resist the temperatures which occur in the subsequent manufacturing steps. A sealing body of a lightly foamed, closed-cell silicone is advantageously used. Such a sealing body is preferably so dimensioned that it fills the cap base and is initially heavily compressed when the caps are positioned and then penetrates into the interior of the tube. As a result of the ability of the material to creep, the fusible conductor, which extends preferably diagonally through the cavity, is subsequently completely surrounded in the vicinity of its ends.

In the method in accordance with the invention for manufacturing a fuse component, a fusible conductor is firstly introduced into the interior of a cylindrical tube, whereby both of its ends are passed around the end surfaces of the tube onto the outer wall of the tube. End caps are then positioned on the ends of the tube with the ends of the fusible conductor passed around the end surfaces. An electrical contact between the end caps and the ends of the fusible conductor is thus formed. A sealing body of a plastic material, which is predominantly elastically compressible and at the same time capable of creep, is then introduced between the inner base of at least one of the two end caps and the end surface of the tube directed towards the inner base, whereby the sealing body is compressed when positioning the end cap. The fuse component is then subjected to a heat treatment at temperatures above 150° C. in order to ensure an electrical contact and/or to mechanically connect the end caps to the tube. Finally a hermetic seal of the interior forms as a result of creep (slow flowing) of the material of the sealing body. It is ensured in this manufacturing process that passages potentially forming in the heat treatment step are subsequently closed again by material flowing into them. The method in accordance with the invention permits, in a simple manner, the manufacture of fuse components with a hermetic seal of their interior.

BRIEF DESCRIPTION OF THE DRAWINGS

Advantageous and preferred features of the invention are characterized in the dependent claims. The invention will be described in more detail with reference to a preferred exemplary embodiment illustrated in the drawings, in which;

DETAILED DESCRIPTION OF THE PREFERRED EMBODIMENT(S)

Figure 1:
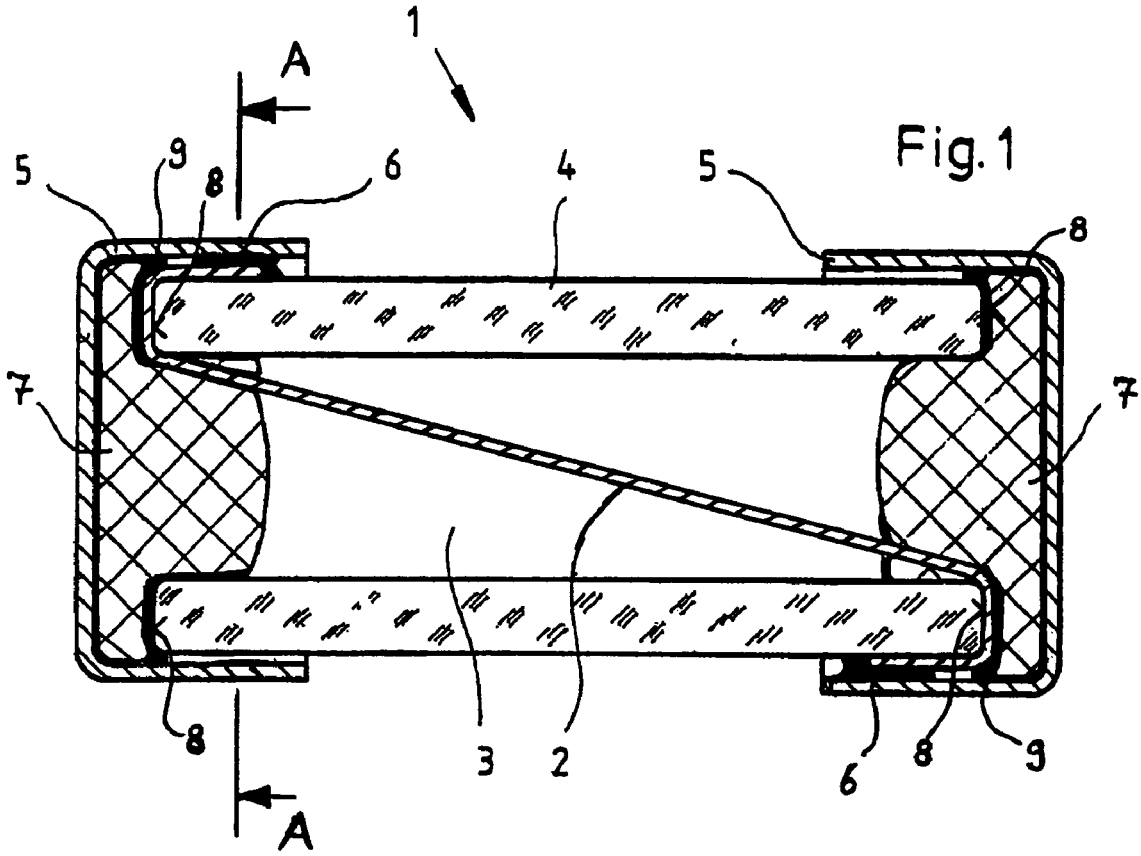
FIG. 1 is a schematic longitudinal sectional view of the fuse component in accordance with the invention.

In the schematic longitudinal sectional view of FIG. 1, a fuse component 1 is illustrated, which has a fusible conductor 2, which extends diagonally in an internal cavity 3 of a cylindrical tube 4. In the embodiment and also in all other embodiments of the invention, the fusible conductor 2 can be not only a wire with any desired cross sectional profile but also a fusible conductive wire wound about an insulating core. The tube 4 has a cylindrical shape, which can have any desired cross sectional profile. The cavity 3 is, for instance, of circular cylindrical shape. The tube 4 is manufactured from an electrically insulating material, for instance of glass, ceramic material or plastic material. In the illustrated exemplary embodiment, the fusible conductor 2 extends diagonally through the cavity 3. In other embodiments, other arrangements of the fusible conductor 2 in the cavity 3 are possible. The fusible conductor 2 is preferably passed around the end surfaces 8 of the tube 4 so that the ends of the fusible conductor 2 engage the external walls of the tube. Positioned on the two ends of the tube 4 are end caps 5 of an electrically conductive material. The metallic end caps are so positioned that, on the one hand, an electrical contact is produced between the end caps 5 and the fusible conductor 2 and, on the other hand, a mechanically rigid connection is formed between the end caps 5 and the tube 4. The fusible conductor 2 is connected to the end caps 5, for instance by means of an external solder connection, i.e., a solder connection 6 connects the ends of the fusible conductor 2 engaging the outer wall of the tube 4 to the internal walls of the metallic end cap 5. In the preferred exemplary embodiment, the mechanical connection of the end caps 5 to the tube 4 is additionally ensured by an adhesive connection 9.

As may be seen in FIG. 1, a respective sealing body 7 is introduced into the gaps between the bases of the end caps 5 and the respective end surfaces 8 of the tube 4 and in a portion of the cavity 3 in the tube 4 adjacent to the cap bases. The sealing body 7 consists of a plastic material, which is elastically compressible (i.e., elastically deformable) but is at the same time capable of creep (in the sense of being able to flow). When the end caps 5 are positioned on the ends of the tube 4, the previously introduced sealing bodies 7 are strongly compressed and subsequently expand again, preferably into the cavity 3. As a result of the flowability, portions of the expanding sealing body 7 penetrate into the gaps present between the caps 5 and tube 4 and surround the sections of the fusible conductor 2 extending in the vicinity of the ends of the tube 4.

Figure 2:
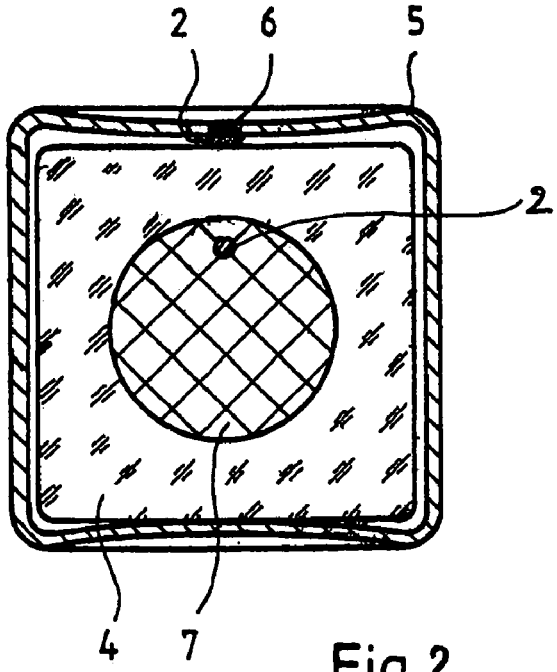
FIG. 2 is a schematic transverse sectional view of the component illustrated in FIG. 1.

FIG. 2 is a schematic transverse sectional view, the section being in the plane designated A in FIG. 1. FIG. 2 shows the state a certain time after manufacture of the fuse component which is sufficient for adequate flow of the introduced material of the sealing body 7. As may be seen in FIG. 2, the fusible conductor 2 spaced from the inner wall of the tube 4 in the sectioned region is completely surrounded by the material of the sealing body 7. Surrounding in this manner is not possible with a merely elastic sealing body but necessitates a material capable of flow.

A preferred method of manufacturing a fuse component in accordance with the invention will be given below. In order to manufacture the fuse component, the fusible conductor 2 is firstly provided in a predetermined length and inserted into the interior 3 of the tube 4 and then bent around the end surfaces 8 of the tube so that the ends of the fusible conductor 2 engage the outer surfaces of the tube 4. A thermally settable adhesive material is then applied to the entire area of the end surfaces 8. The amount of adhesive and the manner of its application are so selected that larger amounts of the adhesive are prevented from flowing into the cavity 3 in the tube 4 during application or during subsequent method steps. A small amount of soldering paste is then applied to the outer surfaces of the tube 4 at the positions where the fusible conductor 2 engages it. The soldering paste includes a flux. The flux should also not flow into the interior 3 of the fuse. This purpose is also served by the adhesive applied to the end surface 8. It forms a barrier and prevents the soldering paste flowing as a result of capillary action along the fusible conductor 2 over the end surface 8 and on into the cavity 3.

In parallel with the aforementioned manufacturing steps, the end caps 5 are prepared by inserting into the inner cap base a piece, whose shape is matched to it, of a foam material (a slightly foamed silicone). The caps are preferably rectangular so that the piece of foam material inserted into the cap base is also of substantially rectangular shape.

In a preferred embodiment, the tube has an internal diameter of about 2.5 mm and external dimensions of about 4 mm×4 mm×9.6 mm. The end caps are about 2.8 mm deep and have a cross-section of about 4.4 mm×4.4 mm. The foam material sealing body inserted into the cap base has a thickness of about 1.5-2.0 mm.

The prepared end caps are positioned on the ends of the tube under the action of a predetermined force so that the foam material deforms and the applied adhesive material is distributed. The caps are then heated (preferably successively) so that, on the one hand, the soldering paste produces a solder connection between the fusible conductor 2 and the inner surfaces of the end caps 5 and, on the other hand, the adhesive 5 is pre-cured so that the caps are mechanically fixed in position. In this step in the manufacture of the solder connection and of the pre-curing of the adhesive, the fuse component is heated to temperatures above 150° C., for instance about 300° C. The overpressure thus produced in the cavity 3 as a result of the gas filling can be balanced out in part by the formation of a narrow passage between the cavity and the external surroundings, for instance along the fusible conductor or along the wall of the tube 4. In a subsequent manufacturing step, the fuse component is heated again to a temperature of, for instance, about 150° C. so that the adhesive is finally cured.

Alternative embodiments are possible within the scope of the inventive concept. For instance, the sealing body 7 could fill only a proportion of the cap base and be, for instance, of annular construction so that it completely fills the gap between the end surfaces and the cap base but only penetrates to a small extent into the cavity 3. Embodiments are also possible in which a sealing body of the aforementioned type is introduced only at one of the two ends of the tube. The other end could be hermetically sealed in a conventional manner, for instance by potting with a plastic material which is liquid and then sets.

What is claimed is:

1. A fuse component, comprising:

a cylindrical tube having an inner wall defining a gas filled cavity, an outer wall, and two opposite ends each having an end surface;

a fusible conductor extending in said cavity between said two ends;

two end caps consisting of an electrically conductive material and each comprising a cap base, said end caps being applied to the ends of the tube such that a respective electrical contact with the fusible conductor is provided, wherein a sealing body of a plastic material is inserted in a gap between the cap base of at least one of the two end caps and the corresponding end surface of the tube and in a portion of the cavity in the tube adjacent to the cap base, said sealing body being compressed between the end surface and the cap base; and wherein a resealable gap is formed in said plastic material between said cavity and an environment surrounding said tube in response to an increase in pressure within said cavity, said gap resealing when said pressure within said cavity becomes at least substantially equal to a pressure of said environment.

2. The fuse component of claim 1, wherein said sealing body consists of a silicone.

3. The fuse component of claim 1, wherein said sealing body consists of a slightly foamed, closed cell silicone.

4. The fuse component of claim 1, wherein the sealing body fills the entire cap base and penetrates into the portion of the cavity in the tube in the maimer of a plug.

5. The fuse component of claim 1, wherein the fusible conductor extends diagonally through the cavity in the cylindrical tube and wherein the two ends of the fusible conductor are connected to opposite surfaces of the outer wall of the tube.

6. The fuse component of claim 5, wherein the tube has a cross-section with a substantially circular internal contour and a substantially rectangular external contour.

7. The fuse component of claim 1, wherein the ends of the fusible conductor are mechanically connected and electrically connected to the end cap between the outer wall of the tube and an inner wall of the end cap extending from the cap base by means of a solder connection.

8. The fuse component of claim 1, wherein the sealing body is introduced at only one end and that the other end of the tube is hermetically sealed with a pourable, cured plastic material.

9. The fuse component of claim 1, wherein the end caps are retained by an adhesive connection, wherein the adhesive distributes itself in the gaps between the end surfaces of the tube, the surfaces of the sealing body directed towards the end surfaces and the cap base and inner walls of the end caps which extend from the cap base.

10. A fuse component, comprising:

a cylindrical tube including an inner wall, defining a gas filled cavity, and two opposed end walls;

a fusible conductor extending in said cavity between said two end walls;

two end caps comprising an electrically conductive material, each end cap including a cap base, spaced from a respective end wall of said tube to define a space therebetween, and a flange extending from said cap base dimensioned to receive a portion of said tube therein, said end caps being applied to said end walls of said tube to create a respective electrical contact with said fusible conductor; and a generally elastic, flowable sealing body inserted in said space between said cap base of at least one of the two end caps and the corresponding end wall of said tube and in a portion of said cavity in said tube adjacent to said cap base, said sealing body being disposed between said end wall and said cap base, and surrounding sections of said fusible conductor; and wherein a resealable gap is formed in said sealing body between said cavity and an environment surrounding said tube in response to an increase in pressure within said cavity, said gap resealing in response to said pressure within said cavity becoming substantially equal to a pressure of said environment.

11. The fuse component of claim 10, wherein said sealing body consists of a silicone.

12. The fuse component of claim 10, wherein said sealing body consists of a slightly foamed, closed cell silicone.

13. The fuse component of claim 10, wherein the sealing body entirely fills said space between said cap base of at least one of the two end caps and the corresponding end wall of said tube and penetrates into the portion of said cavity in said tube in the manner of a plug.

14. The fuse component of claim 10, wherein the end caps are retained by an adhesive connection, wherein the adhesive distributes itself in gaps between said end walls of said tube, surfaces of said sealing body directed towards said end walls, the cap base and said flange.

15. The fuse component of claim 10, wherein the sealing body is introduced at only one end of the tube and the other end of the tube is hermetically sealed with a pourable, cured plastic material.

16. A fuse component, comprising:

a cylindrical tube including an inner wall, defining a gas filled cavity, two opposed end walls and an outer wall;

a fusible conductor extending in said cavity between said two end walls;

two end caps comprising an electrically conductive material, each end cap including a cap base, spaced from a respective end wall of said tube to define a space therebetween, and a flange extending from said cap base dimensioned to receive a portion of said tube therein, said end caps being applied to said end walls of said tube to create a respective electrical contact with said fusible conductor;

a generally elastic, flowable sealing body inserted in said space between said cap base of each end cap and the corresponding end wall of said tube and in a portion of said cavity in said tube adjacent to said cap base, said sealing body being compressed between said end wall and said cap base, and surrounding sections of said fusible conductor; and an adhesive for retaining said end caps, wherein said adhesive distributes itself in gaps between said end walls of said tube, surfaces of said sealing body directed towards said end walls, said cap base and said flange, and wherein a resealable gap is formed in said sealing body between said cavity and an environment surrounding said tube in response to an increase in pressure within said cavity, said gap resealing in response to said pressure within said cavity becoming substantially equal to a pressure of said environment.

17. The fuse component of claim 16, wherein said sealing body consists of a silicone.

18. The fuse component of claim 16, wherein said sealing body consists of a slightly foamed, closed cell silicone.

19. The fuse component of claim 16, wherein the sealing body entirely fills said space between said cap base of each end cap and the corresponding end wall of said tube and penetrates into the portion of said cavity in said tube in the manner of a plug.

* * * * *